US005799461A

United States Patent [19]

Dittemore

[11] Patent Number: 5,799,461

[45] Date of Patent: Sep. 1, 1998

[54] METHOD AND APPARATUS FOR INSULATING BUILDINGS

[76] Inventor: David Dittemore, 5488 Shadow La., Alta Loma, Calif. 91737

[21] Appl. No.: 553,781

[22] Filed: Oct. 23, 1995

[51] Int. Cl.[6] ..... F04B 1/76; F04B 9/04

[52] U.S. Cl. ..... 52/588.1; 52/407.3; 52/407.4; 52/741.4; 52/742.12

[58] Field of Search ..... 52/407.3, 407.4, 52/407.1, 95, 748.1, 746.11, 404.3, 537, 742.12, 741.4, 588.1, 630

[56] References Cited

U.S. PATENT DOCUMENTS

| | | | |
|---|---|---|---|
| 2,330,941 | 10/1943 | Acuff, Jr. | 52/407.1 |
| 3,111,788 | 11/1963 | Ouellet | 52/537 |
| 3,310,925 | 3/1967 | Brun | 52/537 X |
| 3,474,583 | 10/1969 | Manias | 52/407.3 X |
| 3,972,164 | 8/1976 | Grange | 52/95 |
| 3,990,206 | 11/1976 | Reusser | 52/537 X |
| 4,292,777 | 10/1981 | Story | 52/407.1 |
| 4,449,336 | 5/1984 | Kelly | 52/407.1 X |
| 4,566,239 | 1/1986 | Smigel et al. | 52/407.4 |
| 4,715,156 | 12/1987 | Dozzo | 52/404.3 |
| 4,738,072 | 4/1988 | Clemensen et al. | 52/746.11 X |
| 4,977,714 | 12/1990 | Gregory, Jr. | 52/95 |
| 5,088,259 | 2/1992 | Myers | 52/746.11 X |
| 5,339,577 | 8/1994 | Snyder | 52/95 |
| 5,367,849 | 11/1994 | Bullock | 52/746.11 X |
| 5,524,409 | 6/1996 | Kaiser | 52/537 X |
| 5,561,959 | 10/1996 | Alderman et al. | 52/407.3 |

FOREIGN PATENT DOCUMENTS

| | | | |
|---|---|---|---|
| 688535 | 3/1967 | Belgium | 52/537 |
| 5490 | 11/1979 | European Pat. Off. | 52/537 |
| 330554 | 6/1930 | United Kingdom | 52/537 |
| 2089388 | 6/1982 | United Kingdom | 52/407.3 |
| 2204340 | 11/1988 | United Kingdom | 52/407.4 |
| 01702 | 8/1980 | WIPO | 52/95 |
| 04206 | 9/1985 | WIPO | 52/407.4 |

*Primary Examiner*—Michael Safavi

*Attorney, Agent, or Firm*—Blakely Sokoloff Taylor & Zafman LLP

[57] ABSTRACT

A method and apparatus for achieving greater insulative value which can be readily incorporated into existing construction techniques. Composite tray segments are formed preferably having a highly reflective facing layer and integrally formed ribs and interconnection members. The tray segments can be coupled together at the interconnection member to form a tray of any desired length. Using an easily applied adapter, the tray can be placed between two purlins as they are commonly used in standard construction. Additional insulation can be laid over the trays under the upper edge of the purlins such that no compression occurs during roof attachment. Additionally, the reflective air rib created significantly increases the insulative value over that of the insulation layer alone.

8 Claims, 1 Drawing Sheet

METHOD AND APPARATUS FOR INSULATING BUILDINGS

BACKGROUND OF THE INVENTION (1) Field of the Invention

The invention relates to insulation of buildings. More specifically, the invention relates to providing higher R values and lower E values at reduced cost by integrating an insulation tray into currently used construction techniques.

(2) Related Art

Many buildings are constructed incorporating the use of metal beams called purlins to support a metal roof deck. Such buildings have typically been insulated one of two ways: (1) constructing a suspension grid between the purlins to retain insulation, or (2) overlaying insulation over the top of the purlins.

The grid method is both labor and cost intensive. A vinyl blanket is first laid over the grid. The vinyl blanket improves the aesthetic appearance of the ceiling and prevents exposure of the insulative layer such as fiberglass, which is then laid over the vinyl blanket and supported by the grid. The alternate way of insulating such buildings is to lay the insulation, usually fiberglass with a plastic vinyl facing, directly over the purlins. A roof of the structure is then screwed down directly to the purlins through the fiberglass, sandwiching the insulation between the purlins and the roof. As the roof is screwed down, the insulation between the purlins and the roof is compressed, thereby significantly undermining its insulative qualities.

In view of the foregoing, it would be desirable to develop a low cost insulation system for buildings which can be easily integrated into commonly used construction techniques and which provides an improved insulation over known methods.

BRIEF SUMMARY OF THE INVENTION

A method and apparatus for achieving greater insulative value which can be readily incorporated into existing construction techniques is disclosed. Composite tray segments are formed preferably having a highly reflective facing layer and integrally form ribs and interconnection members. The tray segments are coupled together at the interconnection member to form a tray of any desired length. Using an easily applied adapter, the tray can be placed between two purlins as they are commonly used in standard construction. Insulation can be laid over the trays under the upper edge of the purlins such that no compression occurs during roof attachment. Additionally, the reflective air rib created significantly increases the insulative value over that of the insulation layer alone.

DETAILED DESCRIPTION OF THE INVENTION

A method and apparatus for insulating buildings is described. In the following description, numerous specific details are set forth such as specific materials and configurations in order to provide a thorough understanding of the present invention. It will be apparent, however, to one of ordinary skill in the art that the present invention may be practiced without these specific details.

Figure 1:
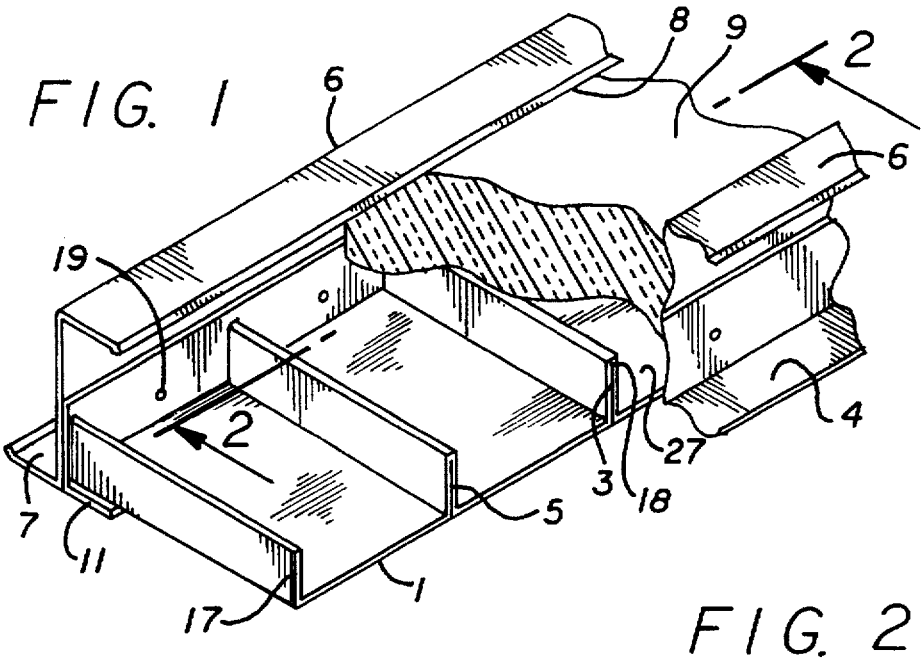
FIG. 1 is a perspective view of the one embodiment of the invention installed.
Figure 2:
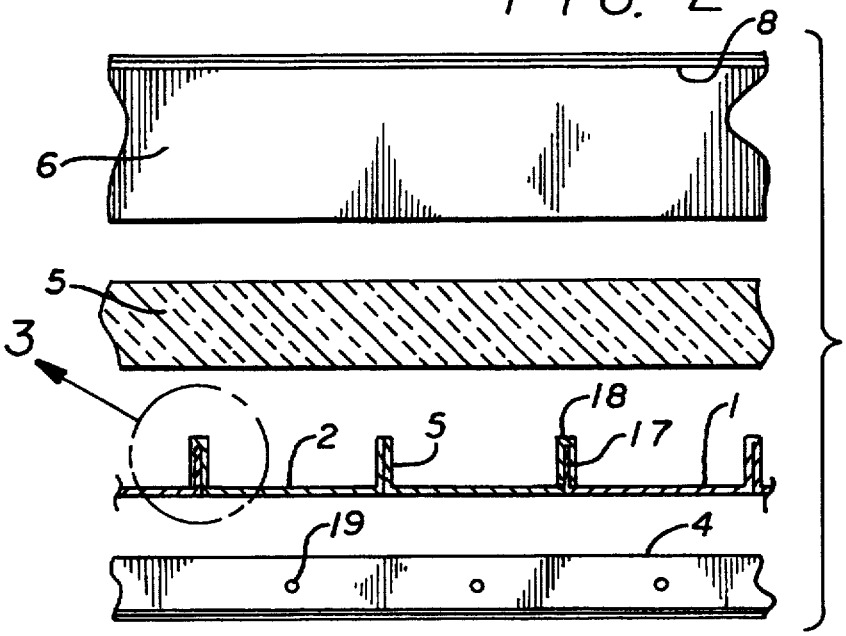
FIG. 2 is an exploded sectional view of the embodiment of FIG. 1.

FIG. 1 shows a perspective view of the instant invention integrated into a conventional building structure. FIG. 2 shows an exploded sectional view of one embodiment of the invention integrated into a conventional building. Typical construction techniques employ purlins 6 having lower lip 7 and upper edge 8 adapter 4 as connected to purlin 6 by adapter connector 19. In one embodiment of the instant invention, a male tray segment 1 is connected to a female tray segment 2 at a male/female connection 3. Both male and female tray segments have integrally formed ribs 5 disposed thereon. A series of such segments are interconnected to extend the lengths of the purlin. The ribs 5 and connection points 3 increase the structural stability of the tray as it rests on adapter 4 and lower lip 7 between a pair of purlins 6. Adapter 4 is not an integral part of the invention, and numerous suitable adapters exist. The insulative blanket 9 can then be overlaid across the trays between the purlins and below upper edge 8 of the purlins. The ribs, in addition to providing structural stability, create an air pocket between the insulative blanket and the trays. Moreover, because the insulative blanket rests entirely below the lower edge 8 of the purlin 6, it is not compressed during roof attachment. The system is a closed system, as there are no gaps between the tray segments, and the trays abut the purlin 6 on both sides. Fiberglass without a vinyl facing can be used for insulative blanket 9. Since there is no interaction between the insulation rib and the room rib below, such insulation is less expensive than its vinyl faced counterpart. The adapter 4 is easily installed. Thus, labor costs are reduced over installing a grid work as previously done.

Figure 3:
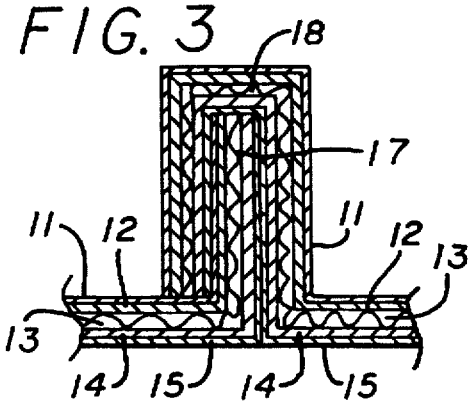
FIG. 3 is an enlarged cutaway view of an interconnection between two tray segments of the invention.

FIG. 3 shows a cutaway expanded view of a male/female techniques interconnection and further details the layers from which the trays are constructed in one embodiment. The trays are constructed of a laminate having five distinct layers in the embodiment shown. External layers 11 and 15 are upper and lower facing layers, respectively. The facing layers may be an alumina film which is highly reflective to light and thermal radiation. Corrugated layer 13 optionally provides an additional inner space and, accordingly, improved insulative properties. Intermediate layers 12 and 14 provide facing on the corrugated surface over which the aluminum film of layers 11 and 15 can be applied. In one embodiment, the conjunction of layers 12, 13, and 14 are each paper layers. It will be recognized that the invention could be practiced without a corrugated core and merely a single layer over which the alumina film is applied. Significantly, the alumina film layer provides an attractive ceiling which being light reflective reduces the ambient light required to illuminate the room in which it is used. In another alternate embodiment, the tray is constructed without either of the radiant or barrier film layers. Such will reduce the insulative value of the tray somewhat, but still allow use of unfaced fiberglass at a significant cost savings and provide a more pleasing appearance.

In an embodiment in which the internal layers are paper layers, the reflective facing layers are laminated to an intermediate layer in sheets. This lamination step produces what is known in the art as liners (a composite of facing and intermediate layers). Lamination of a foil facing layer to a paper layer is generally well known in the art. The facing layers can be any reflective material, for example, any metallic film or even white paper could be used as the facing layer. The more reflective the material, the greater will be the insulative properties of the tray as the efficiency of the reflective air rib created will increase. However, it will be recognized by one of ordinary skill in the art that even a non-reflective tray will provide improved insulation by virtue of the non-reflective air rib created.

Once the liners are created, a third paper layer is steamed to soften the paper and then pass through a corrugator. The corrugated layer is then laminated on either side to the liners. This produces sheets of the five layer material out of which the trays are formed. By appropriately scoring the sheet, the sheet can be folded to produce the ribs and the required male or female ends. Adhesive staples or other conventional connecting devices can be used to retain the ribs in the desired configuration.

FIG. 3 also shows a male/female connection in which the male end 17 of an insulation tray is inserted between the female end 18 of an insulation tray. This action creates a rib three laminate thicknesses in width. The connection can be maintained by stapling through the three layers forming the connection 3. Alternatively, adhesives pins or other conventional connecting devices could be employed. It will be recognized by one of ordinary skill in the art that employing this modular tray segment system, the length of the tray can be any desired length. Traditional construction techniques have 5' between purlins. By manufacturing the trays to be 5' wide, the width commonly used in conventional construction between purlins at this time, the trays will be easily installed with minimal labor costs.

Figure 4:
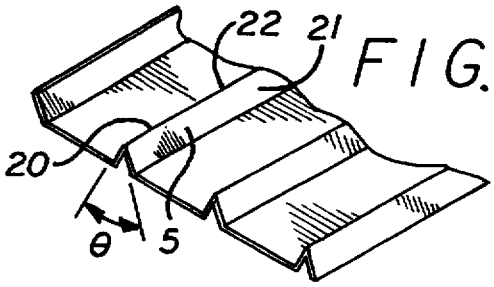
FIG. 4 is a perspective view of an alternative embodiment of a portion of a tray segment of the invention.

FIG. 4 shows an alternate embodiment in which no connecting devices are employed. In such an embodiment, the ribs 5 form a pair of panels 21, 22 meeting along a scored line 20 to form an angle q. The ribs 5 maintain a desired configuration purely as a result of the structural rigidity of the material forming the tray segment.

It should be noted that while FIG. 1 and FIG. 2 reflect male trays 1 and female trays 2 where the ends of any particular tray are either both male ends 17 or both female ends 18, trays having one male end and one female end are also within the scope and contemplation of the instant invention. It is also within the scope and contemplation of the instant invention that any number of ribs 5 could be provided on each tray and that the dimensions of any tray, both length and width, can be increased as required for any particular application. Additionally, the adapter need not be a single piece running the length of the purlin, but could be a plurality of pieces providing periodic support along a tray. Accordingly, an adapter need not run the entire length of a purlin, nor for that matter, need it run the full length of any tray segment. The primary limitation of the adapter is that it must provide sufficient tray support as to prevent undue sagging of the tray over time. Therefore, support should at least be provided along any tray at the ribs 5 and segment interconnection 3.

In the foregoing specification, the invention has been described with reference to specific embodiments thereof. It will however be evident that various modifications and changes can be made thereto without departing from the broader spirit and scope of the invention as set forth in the appended claims. The specification and drawings are, accordingly, to be regarded in an illustrative rather than a restrictive sense. Therefore, the scope of the invention should be limited only by the appended claims.

What is claimed is:

1. An apparatus for insulating a metal building comprising:

a plurality of tray segments each having a uniform width, the tray segments being interconnected to form a tray of a desired length and the uniform width, the tray having an insulative value and integrally formed ribs, the ribs extending the width of the tray wherein the segments are interconnected by inserting a male end into a female end and stapling through the female end and the male end in an inserted position such that the male end is fixedly retained within the female end.

2. The apparatus of claim 1 wherein the try segments comprise a laminate at least one layer of which is a radiant barrier and one layer of which is a corrugated material.

3. The apparatus of claim 1 wherein the tray segments comprise a corrugated layer sandwiched between two radiant barrier layers.

4. The apparatus of claim 1 wherein interconnection of the tray segments creates a rib at each of a plurality of interconnection points.

5. The apparatus of claim 1 wherein the uniform width is approximately five feet.

6. A method of insulating a metal building comprising the steps of:

interconnecting tray segments of a uniform width to form an insulative tray of a desired length and the uniform width, the tray having a plurality of ribs integrally formed therewith and disposed along the length, each rib running the width of the tray;

coupling an adapter to a first purlin of the metal building such that the adapter faces a lower lip of a second purlin of the metal building; and placing the tray such that the tray is supported on opposing sides by the lower lip of the second purlin and the adapter coupled to the first purlin.

7. The method of claim 6 further comprising the step of:

overlaying an insulative blanket such that the blanket is supported by the ribs.

8. A method 6 wherein the tray segments comprise a laminate having a radiant barrier layer.

* * * * *

UNITED STATES PATENT AND TRADEMARK OFFICE

CERTIFICATE OF CORRECTION

PATENT NO. : 5,799,461

DATED : Sept. 1, 1998

INVENTOR(S) : Dittemore

It is certified that error appears in the above-identified patent and that said Letters Patent is hereby corrected as shown below:

In column 4, claim 2 at line 24, please delete " try " and insert -- tray --.

In column 4, claim 8 at line 52, the words -- A method of claim 6 -- should replace -- The method of claim 6 --

Signed and Sealed this

Twenty-fifth Day of July, 2000

*Attest:*

*Attesting Officer*

Q. TODD DICKINSON

*Director of Patents and Trademarks*